US009533349B2

(12) United States Patent
Yokoyama et al.

(10) Patent No.: US 9,533,349 B2
(45) Date of Patent: Jan. 3, 2017

(54) CASTING MOLD

(71) Applicant: HONDA MOTOR CO., LTD., Tokyo (JP)

(72) Inventors: Kunihiro Yokoyama, Troy, OH (US); Hiroshi Matsushita, Shimotsuke (JP); Takayuki Higashi, Utsunomiya (JP); Hiromi Fujita, Sakura (JP); Masanori Masubuchi, Moka (JP); Kenichi Katahira, Utsunomiya (JP); Yoshinori Kubo, Utsunomiya (JP); Takanori Niwa, Utsunomiya (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/785,678

(22) PCT Filed: Apr. 2, 2014

(86) PCT No.: PCT/JP2014/059711

§ 371 (c)(1),
(2) Date: Oct. 20, 2015

(87) PCT Pub. No.: WO2014/175019

PCT Pub. Date: Oct. 30, 2014

(65) Prior Publication Data

US 2016/0067772 A1 Mar. 10, 2016

(30) Foreign Application Priority Data

Apr. 22, 2013 (JP) ..... 2013-089629

(51) Int. Cl.

| | |
|---|---|
| ***B22D 17/22*** | (2006.01) |
| ***B22C 9/06*** | (2006.01) |
| ***B22D 17/20*** | (2006.01) |

(52) U.S. Cl.
CPC ..... *B22D 17/22* (2013.01); *B22C 9/06* (2013.01); *B22D 17/2015* (2013.01); *B22D 17/2227* (2013.01); *B22D 17/2236* (2013.01)

(58) Field of Classification Search
CPC ..... B22D 17/22; B22D 17/2227; B22C 9/06
(Continued)

(56) References Cited

U.S. PATENT DOCUMENTS

| | | | | |
|---|---|---|---|---|
| 6,374,900 | B1 * | 4/2002 | Campbell | B22D 17/22 164/121 |
| 2011/0088866 | A1 * | 4/2011 | Mizukusa | B22D 17/14 164/305 |

FOREIGN PATENT DOCUMENTS

| | | |
|---|---|---|
| JP | 57-181463 | 11/1982 |
| JP | 61-226159 | 10/1986 |

(Continued)

OTHER PUBLICATIONS

EPO machine translation of JP 2011-245489, Dec. 8, 2011.*

(Continued)

*Primary Examiner* — Kevin E Yoon
(74) *Attorney, Agent, or Firm* — Rankin, Hill & Clark LLP

(57) ABSTRACT

Provided is a highly versatile casting mold in which weight and manufacturing cost can be reduced, and whereby flash can be suppressed. A plate-shaped base part having a flat attachment face to which a back face of a fixed-cavity mold is attached is provided to a fixed mold constituting a casting mold. A portion of the base part in contact with the back face of the fixed-cavity mold has an attachment part body for supporting the fixed-cavity mold, and a pressure increasing means for increasing the pressure imparted to the fixed-cavity mold via the attachment part body in a state in which the mold is closed.

8 Claims, 17 Drawing Sheets

(58) Field of Classification Search
USPC ..... 164/113, 303–319
See application file for complete search history.

(56) References Cited

FOREIGN PATENT DOCUMENTS

| | | | | |
|---|---|---|---|---|
| JP | 62114764 | A | * | 5/1987 |
| JP | 63144852 | A | * | 6/1988 |
| JP | H06-34843 | | | 5/1994 |
| JP | 2007-000916 | | | 1/2007 |
| JP | 2011-245489 | | | 12/2011 |

OTHER PUBLICATIONS

EPO machine translation of JP 2007-000916, Jan. 11, 2007.*
International Search Report, Date of mailing: Jul. 8, 2014 (Jul. 8, 2014).

* cited by examiner

CASTING MOLD

TECHNICAL FIELD

The present invention relates to a casting die assembly (casting mold) including a plate-shaped base having a flat attachment surface to which the rear surface of a cavity die is attached.

BACKGROUND ART

One known type of casting die assembly is made up from a fixed die and a movable die, each having a thick die block with a recess defined therein, and a cavity die that is fitted in the recess (see FIG. 5 of Japanese Laid-Open Patent Publication No. 61-226159). The casting die assembly is highly costly to manufacture because it is necessary to bore the recess highly precisely. The casting die assembly also is problematic in that it is heavy, since the die block with the recess defined therein is thick. Further, the casting die assembly is not versatile in use, due to the fact that the cavity die and the recess must be complementary in shape to each other.

To solve the aforementioned problems, there has been proposed a casting die assembly including dies, each of which has a flat attachment surface on which the rear surface of a cavity die is mounted (see, for example, Japanese Laid-Open Patent Publication No. 61-226159). Since the dies of the proposed casting die assembly do not require a recess for a cavity die to be fitted therein, the casting die assembly is relatively low in cost and weight, and is highly versatile in use.

SUMMARY OF INVENTION

If each of the dies disclosed in Japanese Laid-Open Patent Publication No. 61-226159 is formed into a plate shape in order to reduce the weight thereof, then the die is reduced in rigidity and tends to be deformed easily when the casting die assembly is closed. When the dies are deformed, the cavity dies also are deformed in a corresponding manner. Therefore, a gap tends to be formed between the cavity die of the fixed die and the cavity die of the movable die, which connects the cavity to the exterior of the casting die assembly. The gap allows molten metal that is poured into the cavity to leak out, thereby producing a phenomenon called "metal spits" that is liable to produce burrs on the cast product.

It is an object of the present invention to provide a casting die assembly, which is relatively low in cost and weight, is highly versatile in use, and prevents burrs from being produced on cast products.

According to the present invention, there is provided a casting die assembly including a first die and a second die, which face each other and are configured to be movable toward and away from each other, wherein at least one of the first die and the second die includes a cavity die and a plate-shaped base having a flat attachment surface to which a rear surface of the cavity die is attached, and wherein the base includes a region held in contact with the rear surface of the cavity die. The region includes a support configured to support the cavity die, and a pressure boosting unit configured to increase a pressure applied through the support to the cavity die when the first die and the second die are combined with each other.

With the casting die assembly according to the present invention, when the first die and the second die are combined, the pressure boosting unit increases the pressure applied through the support to the cavity die, thereby minimizing deformation of the portion of the cavity die that is supported by the support. Since any gap connecting the cavity formed by the cavity die to the exterior of the casting die assembly is prevented from being formed upon closure of the casting die assembly, i.e., when the first die and the second die are combined with each other, burrs on the cast product are minimized. Further, since the rear surface of the cavity die is attached to the flat attachment surface of the plate-shaped base, the base does not require a recess in which the cavity die is fitted. Consequently, it is possible to reduce the manufacturing cost and weight of the casting die, and the casting die assembly can be made versatile in use.

In the above casting die assembly, the pressure boosting unit may have a deformable portion, which is less rigid than the support, the deformable portion being configured to be elastically deformed to become convex away from the cavity die when the first die and the second die are combined with each other.

With the above arrangement, when the first die and the second die are combined, the deformable portion is elastically deformed in a convex manner away from the cavity die, such that an elastic force (restoring force) of the deformable portion acts on the support. Therefore, when the first die and the second die are combined with each other, pressure applied to the cavity die through the support is increased to an appropriate level.

In the casting die assembly, the deformable portion may be thinner than the support. Consequently, the deformable portion effectively is made elastically deformable while the support is made less deformable. Therefore, burrs on the cast product are minimized efficiently.

In the casting die assembly, the deformable portion may have a through hole therein. In this manner, the rigidity of the deformable portion becomes smaller than the rigidity of the support, thereby making the deformable portion more elastically deformable.

In the casting die assembly, the pressure boosting unit may have a hole therein. Therefore, it is possible for the contact area of the cavity die with the base to be reduced without changing the contact area of the cavity die with the support. Consequently, the pressure applied through the support to the cavity die can be increased to an appropriate level.

The casting die assembly may further include a plurality of ejector pins configured to remove a cast product from the cavity die, and the hole may be large enough for the ejector pins to be inserted therein.

With the above arrangement, the hole is large enough for the ejector pins to be inserted therein. Therefore, even if the layout of the ejector pins is changed depending on the shape of the cast product, the ejector pins can be inserted in the hole. In other words, the hole doubles as a hole through which the ejector pins can be inserted. Stated otherwise, there is no need for a new main die body to be produced responsive to changes made in the layout of the ejector pins. Consequently, the manufacturing cost of the casting die assembly is prevented from increasing, even if differently shaped products are cast.

In the above casting die assembly, the support may be disposed around the pressure boosting unit, and the pressure boosting unit may be disposed behind a cavity-forming portion of the cavity die. Accordingly, deformation of the portion of the cavity die that is positioned around the cavity-forming portion is minimized. Therefore, burrs on the cast product are minimized efficiently.

The casting die assembly may further include a flange that projects from the base toward the cavity die and abuts against a side surface of the cavity die, and a joint member configured to join the flange and the cavity die to each other.

With the above arrangement, since the cavity die and the flange are joined to each other by the joint member, the cavity die is prevented from becoming displaced in position with respect to the base upon thermal expansion and contraction of the cavity die. The cavity die is thermally expandable away from the flange, so that the flange and the cavity die are prevented from becoming damaged when the cavity die undergoes thermal expansion.

In the casting die assembly, the flange may have a first surface facing the cavity die, and the first surface may have a first recess in which a portion of a sprue sleeve or a portion of a sprue pin is disposed. The cavity die may have a second surface facing the flange, and the second surface may have a second recess in which another portion of the sprue sleeve or another portion of the sprue pin is disposed. When the sprue sleeve or the sprue pin is disposed in the first recess and the second recess, the cavity die may be positioned with respect to the base along a direction perpendicular to the direction in which the flange projects, and perpendicular to the direction in which the first surface faces.

Accordingly, the cavity die can easily be positioned with respect to the base along a direction perpendicular to the direction in which the flange projects and perpendicular to the direction in which the first surface faces. Therefore, since the sprue sleeve or the sprue pin can be used as a positioning member, it is unnecessary for a new dedicated positioning member to be provided, thus resulting in a reduction in the number of parts. Since positional displacement of the cavity die with respect to the base is prevented, the dimensional accuracy of a cast product can be increased.

In the casting die assembly, in the hole, a reinforcement member may be provided by being fixed to the rear surface of the cavity die. With this arrangement, the reinforcement member can prevent the cavity die from being excessively deformed during the casting process. As a result, the dimensional accuracy of a cast product can be increased.

In the casting die assembly, the reinforcement member may be formed by stacking a plurality of metal plates. With this arrangement, by changing the number of stacked metal plates, the rigidity of the reinforcement member can be adjusted easily.

With the casting die assembly according to the present invention, when the first die and the second die are combined, the pressure applied by the pressure boosting unit to the cavity die through the support is increased, thereby minimizing burrs on the cast product. Since the base, which serves as a main die body, is shaped as a plate, it is possible to reduce the manufacturing cost and weight of the casting die assembly, and the casting die assembly can be made versatile in use.

DESCRIPTION OF EMBODIMENTS

Casting die assemblies according to preferred embodiments of the present invention will be described in detail below with reference to the accompanying drawings.

First Embodiment

Figure 1:
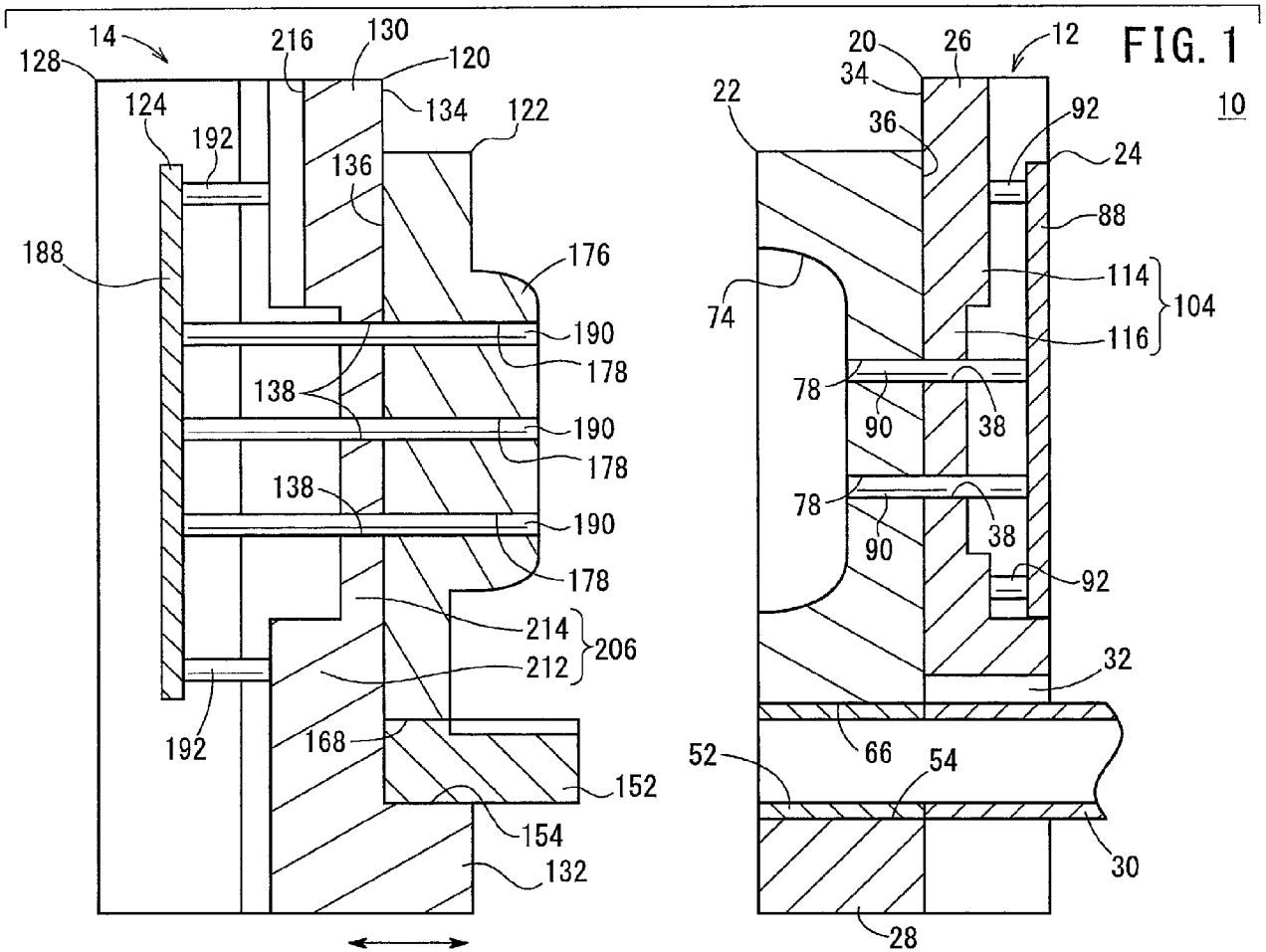
FIG. 1 is a vertical cross-sectional view, partially omitted from illustration, of a casting die assembly according to a first embodiment of the present invention, with the casting die assembly being shown in an open state.
Figure 2:
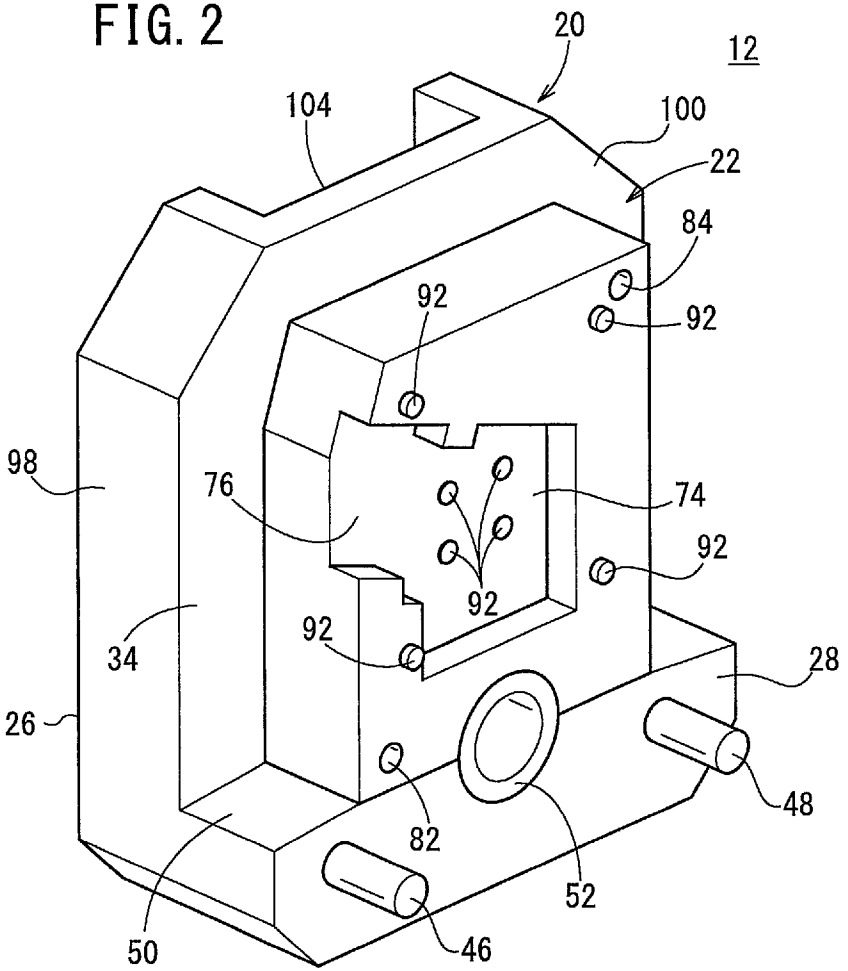
FIG. 2 is a perspective view of a fixed die of the casting die assembly, with a front side of the fixed die being shown.
Figure 3:
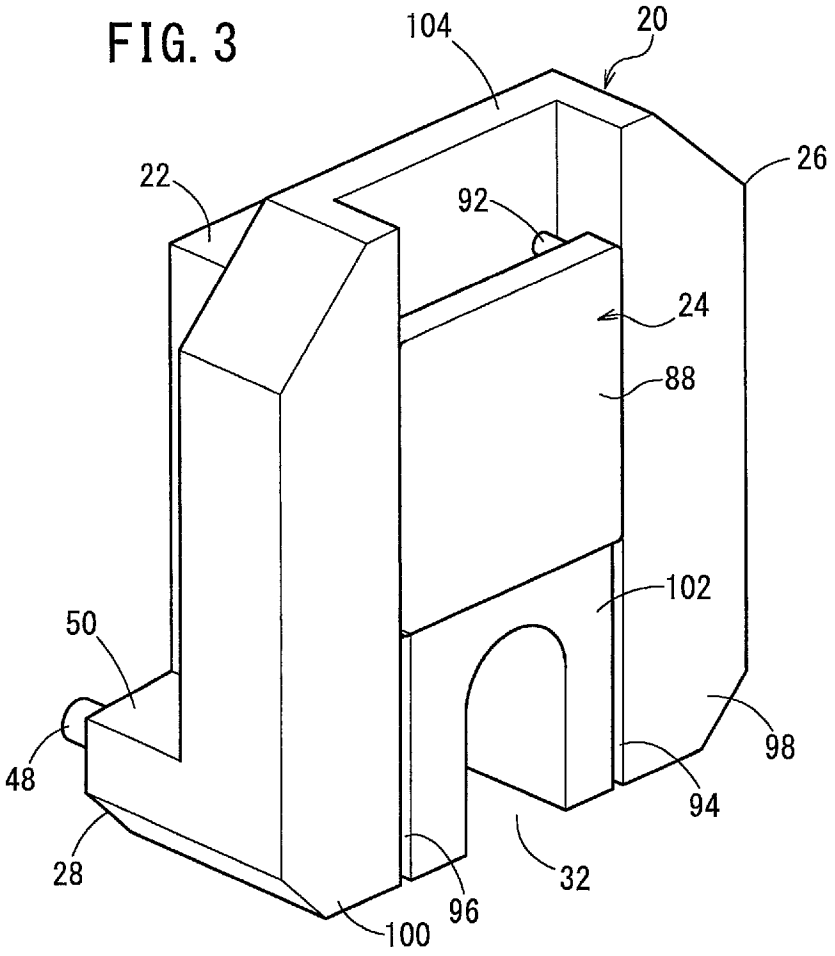
FIG. 3 is a perspective view of the fixed die shown in FIG. 2, with a rear side of the fixed die being shown.

Firstly, a casting die assembly 10 according to a first embodiment of the present invention will be described below. The casting die assembly 10 is a die assembly for use in a die casting process. Further, as shown in FIG. 1, the casting die assembly 10 includes a fixed die (first die) 12 and a movable die (second die) 14, which face each other and are movable toward and away from each other, and a slide die 16 and a slide mechanism 18 (see FIG. 7), which are mounted on the movable die 14. Upon closure of the casting die assembly 10, the fixed die 12, the movable die 14, and the slide die 16 jointly define a cavity C (see FIG. 12), which is complementary in shape to a cast product.

First, structural details of the fixed die 12 will be described below. As shown in FIGS. 1 through 4, the fixed die 12 has a main fixed die body 20, a fixed cavity die 22 constructed from a plate mounted on the main fixed die body 20, and an ejector mechanism 24 for ejecting a cast product out of the fixed cavity die 22. The main fixed die body 20 includes a plate-shaped base 26, and a flange 28 that projects from the base 26 toward the fixed cavity die 22.

The base 26, which is substantially rectangular as viewed in front elevation, has a longitudinal end from which the flange 28 projects. Thus, the main fixed die body 20 is substantially L-shaped as viewed in side elevation. The base 26 has a sleeve placement hole 32 defined substantially centrally widthwise (transversely) in one end thereof. An injection sleeve 30 (FIG. 1) for introducing molten metal is disposed in the sleeve placement hole 32. The base 26 has a flat attachment surface (flat surface) 34 held in contact with the fixed cavity die 22. The attachment surface 34 is flat over the entire surface. The flat attachment surface 34 is greater in size than a flat rear surface 36 (FIG. 1) of the fixed cavity die 22.

Figure 4:
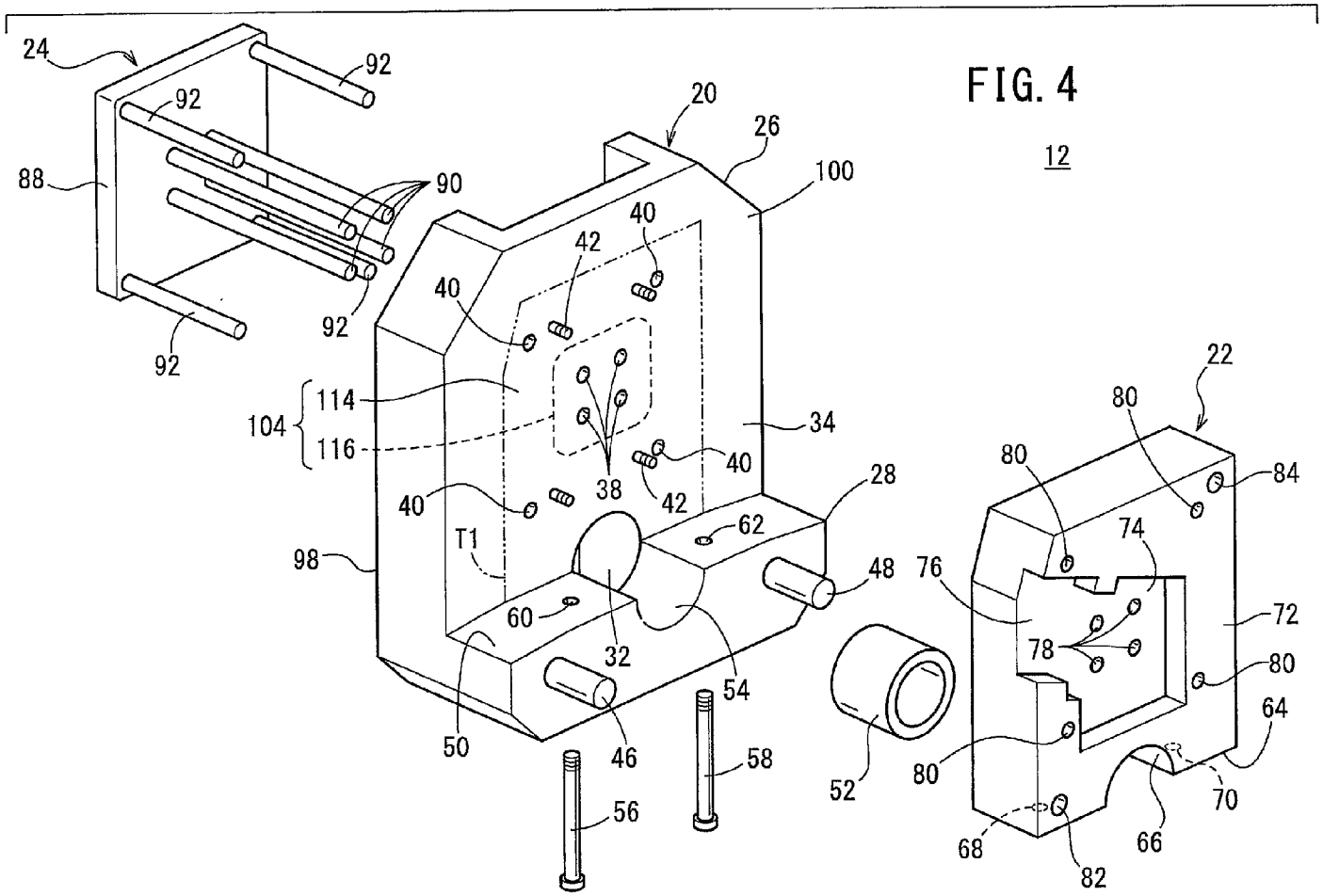
FIG. 4 is an exploded perspective view of the fixed die shown in FIG. 2.

As shown in FIG. 4, the base 26 includes a plurality of (four as illustrated) through holes 38 defined in a central region thereof, and a plurality of (four as illustrated) pin holes 40 defined in a region around the through holes 38. The ejector mechanism 24 has ejector pins 90, to be described later, which are inserted respectively in the through holes 38, and return pins 92, to be described later, which are inserted respectively in the pin holes 40. A plurality of mounting bolts 42 for fastening the fixed cavity die 22 are mounted on the base 26. Other details of the base 26 will be described later.

The flange 28 extends over the full width of the base 26. The flange 28 projects from the base 26 by a given length that is substantially the same as the thickness of the fixed cavity die 22. The flange 28 has a pair of positioning pins 46, 48 mounted on a tip end face thereof. The positioning pins 46, 48 are transversely spaced from each other. The flange 28 has a first surface 50 that faces toward the flat attachment surface 34, i.e., toward the fixed cavity die 22 combined with the main fixed die body 20, and a first recess 54 defined in the first surface 50 for receiving a portion of a sprue sleeve 52. The sprue sleeve 52 is joined end-to-end with the injection sleeve 30 for guiding molten metal from the injection sleeve 30 into the cavity C.

According to the present embodiment, the sprue sleeve 52 is of a tubular shape, although the sprue sleeve 52 may be of any desired shape. The first recess 54, which is positioned substantially centrally widthwise in the flange 28, is shaped in a complementary manner to one-half of the outer shape of the sprue sleeve 52. According to the present embodiment, the first recess 54 is of a semicircular transverse shape, although the first recess 54 may be of any desired shape. The flange 28 also has a pair of insertion holes 60, 62 defined therein for insertion of a pair of respective joint bolts (joint members) 56, 58 that serve to interconnect the flange 28 and the fixed cavity die 22. The insertion holes 60, 62 extend along the longitudinal direction of the base 26, and open at the first surface 50 on both sides of the first recess 54.

The fixed cavity die 22, which extends along the longitudinal direction of the base 26, is of a substantially rectangular shape as viewed in front elevation. The fixed cavity die 22 is attached to the main fixed die body 20 while remaining in contact with the flat attachment surface 34 of the base 26 and the first surface 50 of the flange 28. The fixed cavity die 22 has a second surface 64, which faces toward the flange 28. The second surface 64 has a second recess 66 defined therein, which receives the other portion of the sprue sleeve 52.

The second recess 66 is positioned substantially centrally widthwise (transversely) in the fixed cavity die 22, and is shaped in a complementary manner to one-half of the outer shape of the sprue sleeve 52. According to the present embodiment, the second recess 66 is of a semicircular transverse shape, although the second recess 66 may be of any desired shape. The second surface 64 of the fixed cavity die 22 has a pair of bolt holes 68, 70 defined therein on both sides of the second recess 66 for receiving the respective joint bolts 56, 58 in a threaded manner therein.

The fixed cavity die 22 has a mating surface 72 located remotely from the base 26. The mating surface 72 includes a concave cavity-forming portion 74, and a clearance 76 that prevents the mating surface 72 from interfering with the slide die 16 (see FIG. 7). The fixed cavity die 22 has a plurality of through holes 78 for insertion of respective ejector pins 90 therein, and a plurality of pin holes 80 for insertion of respective return pins 92 therein. The through holes 78 open toward the cavity-forming portion 74, whereas the pin holes 80 open toward the mating surface 72. The mating surface 72 has a pair of positioning holes (bushings) 82, 84 defined in respective diagonal corners thereof.

The ejector mechanism 24 has a square ejector plate 88 disposed behind the main fixed die body 20. The ejector pins 90 are fixed to a central region of the ejector plate 88, and the return pins 92 are fixed to respective corners of the ejector plate 88. The ejector plate 88 can be pressed toward the base 26 by a non-illustrated pressing means. The ejector pins 90, which serve to eject a cast product from the cavity-forming portion 74 when pressed by the ejector plate 88, extend through respective through holes 38, which are defined in the main fixed die body 20, and extend through respective through holes 78, which are defined in the fixed cavity die 22. The return pins 92, which serve to return the pressed ejector pins 90 to their initial non-pressed positions, extend through respective pin holes 40, which are defined in the main fixed die body 20, and extend through the respective pin holes 80, which are defined in the fixed cavity die 22.

Figure 5:
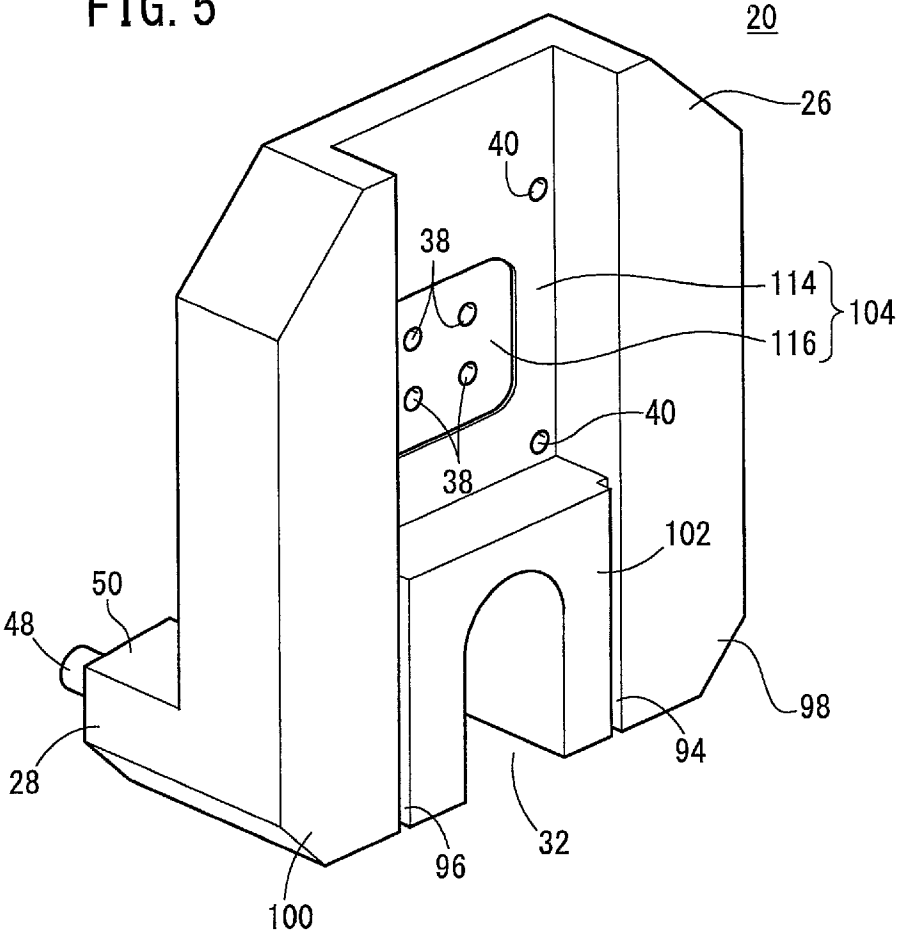
FIG. 5 is a perspective view of a main fixed die body of the fixed die, with a rear side of the main fixed die body being shown.

As shown in FIGS. 4 and 5, the base 26 includes a substantially rectangular channel defined substantially centrally widthwise in a rear surface thereof, and which extends from the other longitudinal end of the base 26 terminating short of the sleeve placement hole 32. The base 26 also includes a pair of slits 94, 96, which are defined on opposite sides of the sleeve placement hole 32, and extend from the base 26 longitudinally toward one end thereof remote from the channel.

The channel, which is defined in the base 26, forms the base 26 into a pair of side blocks 98, 100, a portal-shaped wall 102 in which the sleeve placement hole 32 is defined, and a thin-walled attachment plate 104 that extends between the side blocks 98, 100 and is joined to one end of the wall 102 remote from the sleeve placement hole 32. The ejector plate 88 is disposed in the channel behind the attachment plate 104 (see FIG. 3).

The attachment plate 104 includes a main attachment plate body (support) 114, which lies between the side blocks 98, 100 behind the channel, and a thin-walled panel (pressure boosting unit, deformable portion) 116 disposed inside and formed thinner than the main attachment plate body 114. In other words, the main attachment plate body 114 is positioned around the thin-walled panel 116.

The thin-walled panel 116 is positioned behind the concave cavity-forming portion 74 of the fixed cavity die 22 (see FIG. 1). The main attachment plate body 114 has the pin holes 40 defined therein, and the thin-walled panel 116 has the through holes 38 defined therein. The thin-walled panel 116 is lower in rigidity than the main attachment plate body 114. More specifically, the rigidity of the thin-walled panel 116 is such that, when the casting die assembly 10 is closed, the thin-walled panel 116 is elastically deformed to become convex away from the fixed cavity die 22. Thus, the thin-walled panel 116 is more elastically deformable than the main attachment plate body 114.

Figure 6:
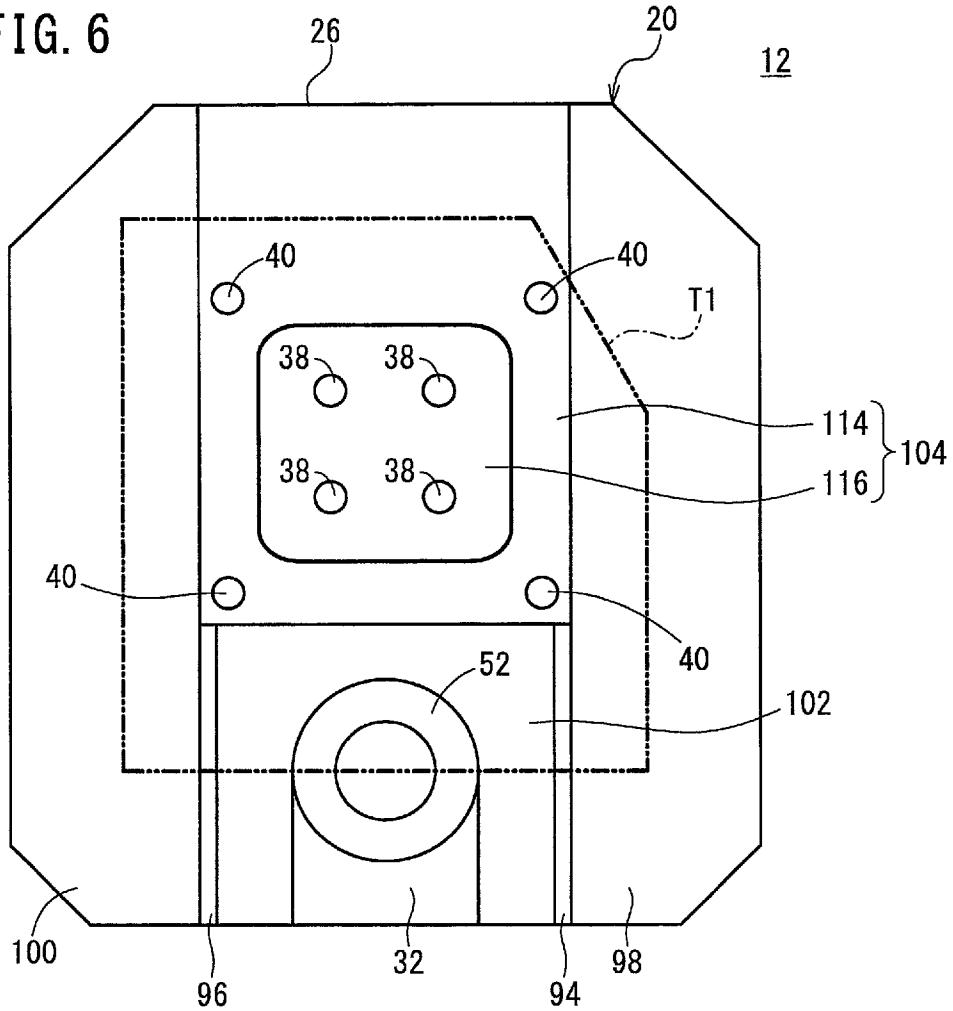
FIG. 6 is a rear elevational view of the main fixed die body shown in FIG. 5.

As shown in FIGS. 4 and 6, the base 26 includes a region T1, i.e., the region indicated by the two-dot-and-dash lines shown in FIGS. 4 and 6, which is referred to as a first contact region and is in contact with the flat rear surface 36 of the fixed cavity die 22. The region T1 includes the main attachment plate body 114 and the thin-walled panel 116, both of which support the fixed cavity die 22.

In the fixed die 12 as above, the fixed cavity die 22 is installed on the main fixed die body 20 in the following manner. First, the fixed cavity die 22 is placed on the main fixed die body 20 such that the flat rear surface 36 of the fixed cavity die 22 is brought into contact with the flat attachment surface 34 of the base 26, and the first surface 50 of the flange 28 is brought into contact with or abutment against the second surface 64 of the fixed cavity die 22.

At this time, the sprue sleeve 52 is disposed in the first recess 54 and the second recess 66, thereby positioning the fixed cavity die 22 with respect to the main fixed die body 20 along the transverse direction of the base 26.

Thereafter, the mounting bolts 42 mounted on the base 26 are threaded into respective bolt holes, not shown, defined in the flat rear surface 36 of the fixed cavity die 22. In addition, the joint bolts 56, 58 are inserted respectively through the insertion holes 60, 62 in the flange 28 and threaded into the respective bolt holes 68, 70 in the fixed cavity die 22. As a result, the fixed cavity die 22 is fastened to the main fixed die body 20.

The movable die 14 will be described below. As shown in FIGS. 1 and 7 through 9, the movable die 14 includes a main movable die body 120, a movable cavity die 122 constructed from a plate that is mounted on the main movable die body 120, an ejector mechanism 124, and a pair of support blocks 126, 128. The main movable die body 120 includes a plate-shaped base 130, and a flange 132 that projects from the base 130 toward the movable cavity die 122.

The base 130, which is substantially rectangular when viewed in front elevation, has a longitudinal end from which the flange 132 projects. Thus, the main movable die body 120 is substantially L-shaped as viewed in side elevation. The base 130 has a flat attachment surface (flat surface) 134, which is held in contact with the movable cavity die 122, and is greater in size than a flat rear surface 136 (FIG. 1) of the movable cavity die 122.

Figure 9:
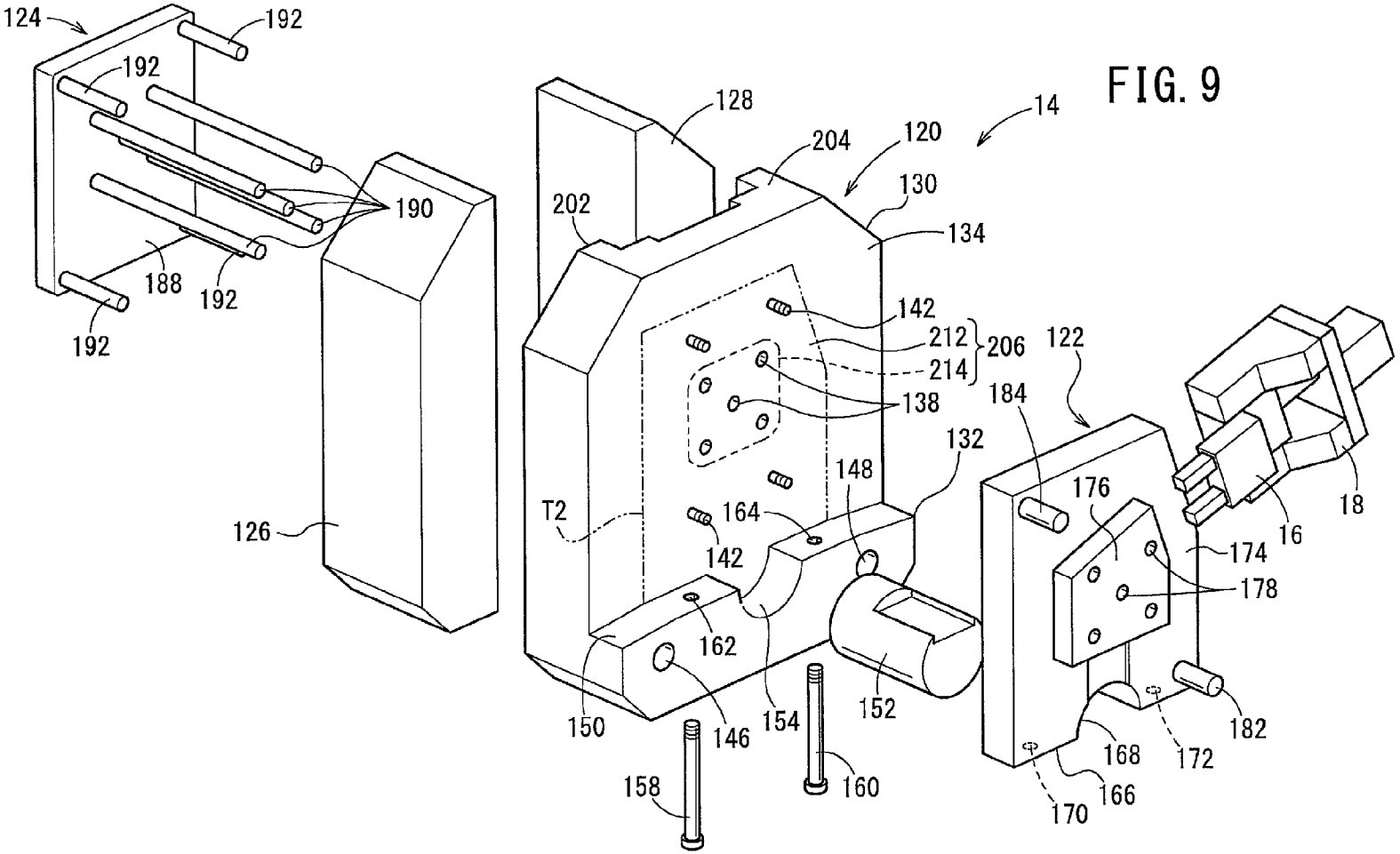
FIG. 9 is an exploded perspective view of the movable die shown in FIG. 7.

As shown in FIG. 9, the base 130 has a plurality of (five as illustrated) through holes 138 defined in a central region thereof. The ejector mechanism 124 has ejector pins 190, which are inserted respectively into the through holes 138. Plural mounting bolts 142 are mounted on the base 130, which serve to fasten the movable cavity die 122. Other details of the base 130 will be described later.

The flange 132 extends over the full width of the base 130. The flange 132 projects from the base 130 by a given length, which is substantially the same as the thickness of the movable cavity die 122. The flange 132 has a pair of positioning holes (positioning bushings) 146, 148 defined in a tip end face thereof for receiving the respective positioning pins 46, 48 on the flange 28 of the fixed die 12. The flange 132 includes a first surface 150, which faces toward the flat attachment surface 134, i.e., toward the movable cavity die 122 combined with the main movable die body 120, and a first recess 154, which is defined in the first surface 150 for receiving a portion of a sprue pin 152. The sprue pin 152 serves to guide molten metal into the cavity C.

The sprue pin 152 may be of any desired shape, although according to the present embodiment, the sprue pin 152 is in the form of a cylinder with an axial groove defined in the outer circumferential surface thereof. Upon closure of the casting die assembly 10, the sprue pin 152 is inserted into the sprue sleeve 52 of the fixed die 12, thereby forming a sprue runner 156 (see FIG. 12) between the sprue pin 152 and the sprue sleeve 52. The first recess 154 is positioned substantially centrally widthwise in the flange 132, and is shaped in a complementary manner to one-half of the outer shape of the sprue pin 152. According to the present embodiment, the first recess 154 is of a semicircular transverse shape, although the first recess 154 may be of any desired shape.

The flange 132 also has a pair of insertion holes 162, 164 defined therein into which a pair of respective joint bolts (joint members) 158, 160 are inserted for interconnecting the flange 132 and the movable cavity die 122. The insertion holes 162, 164 extend along the longitudinal direction of the base 130, and open at the first surface 150 on both sides of the first recess 154.

The movable cavity die 122 extends along the longitudinal direction of the base 130, and is mounted on the main movable die body 120 while remaining in contact with the flat attachment surface 134 of the base 130 and the first surface 150 of the flange 132. The movable cavity die 122 is in the shape of a rectangle, with one corner thereof beveled into a slanted surface on which the slide mechanism 18 is fixed (see FIG. 7). The movable cavity die 122 has a second surface 166, which faces toward the flange 132, and has a second recess 168 defined therein that receives the other portion of the sprue pin 152.

The second recess 168 is positioned substantially centrally widthwise (transversely) in the movable cavity die 122, and is shaped in a complementary manner to one-half of the outer shape of the sprue pin 152. According to the present embodiment, the second recess 168 is of a semicircular transverse shape, although the second recess 168 may be of any desired shape. The second surface 166 of the movable cavity die 122 has a pair of bolt holes 170, 172 defined therein on both sides of the second recess 168 into which the respective joint bolts 158, 160 are threaded and received.

The movable cavity die 122 has a mating surface 174, which is located remotely from the base 130. The mating surface 174 has a convex cavity-forming portion 176. The movable cavity die 122 includes a plurality of (five as illustrated) through holes 178 into which the respective ejector pins 190 are inserted and received. The through holes 178 open at the cavity-forming portion 176. The mating surface 174 includes a pair of positioning pins 182, 184, which are disposed in respective diagonal corners thereof for insertion into the respective positioning holes 82, 84 of the fixed cavity die 22.

The ejector mechanism 124 has a rectangular ejector plate 188, which is disposed behind the main movable die body 120, the ejector pins 190, which are fixed to a central region of the ejector plate 188, and a plurality of projection limiting pins 192. The ejector pins 190 extend through the respective through holes 138, which are defined in the main movable die body 120, and the respective through holes 178, which are defined in the movable cavity die 122. By coming into contact with the rear surface of the main movable die body 120, the projection limiting pins 192 serve to limit the length by which the ejector pins 190 project from the movable cavity die 122.

The support blocks 126, 128 extend along the longitudinal direction of the base 130, and are spaced transversely from each other behind the base 130. The ejector plate 188 is supported by the support blocks 126, 128 for movement along the thicknesswise direction thereof. The support blocks 126, 128 may be hollowed out in order to reduce the weight of the support blocks 126, 128.

Figure 10:
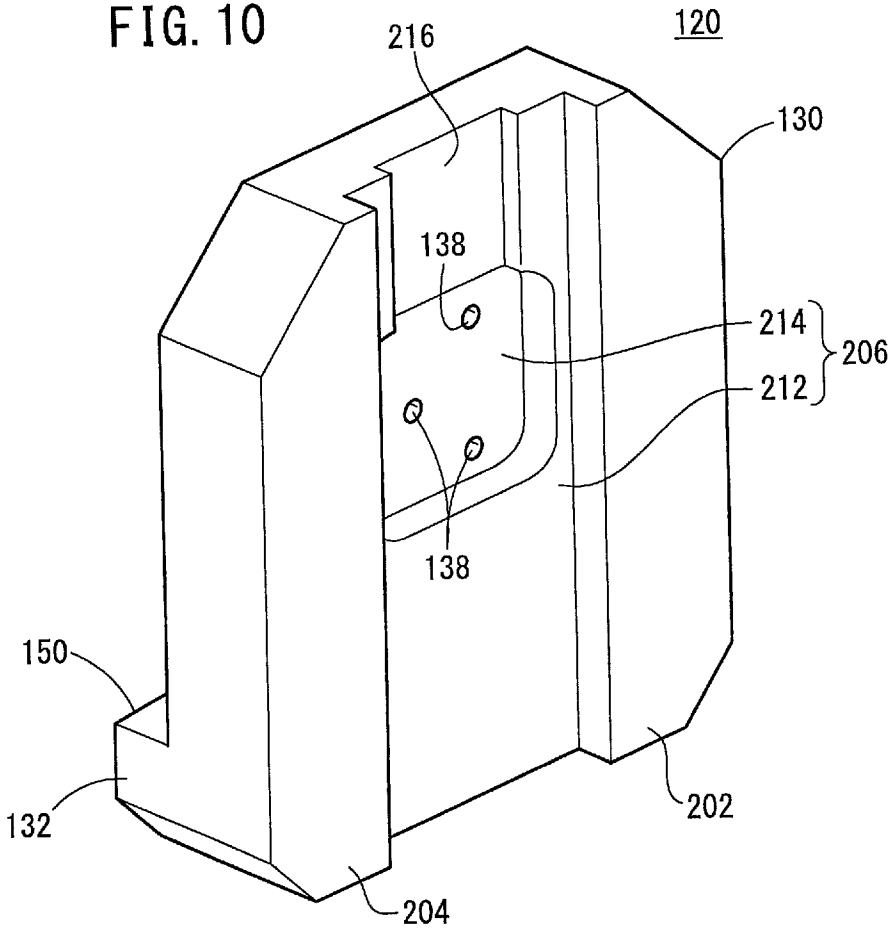
FIG. 10 is a perspective view of a main movable die body of the movable die, with a rear side of the main movable die body being shown.
Figure 11:
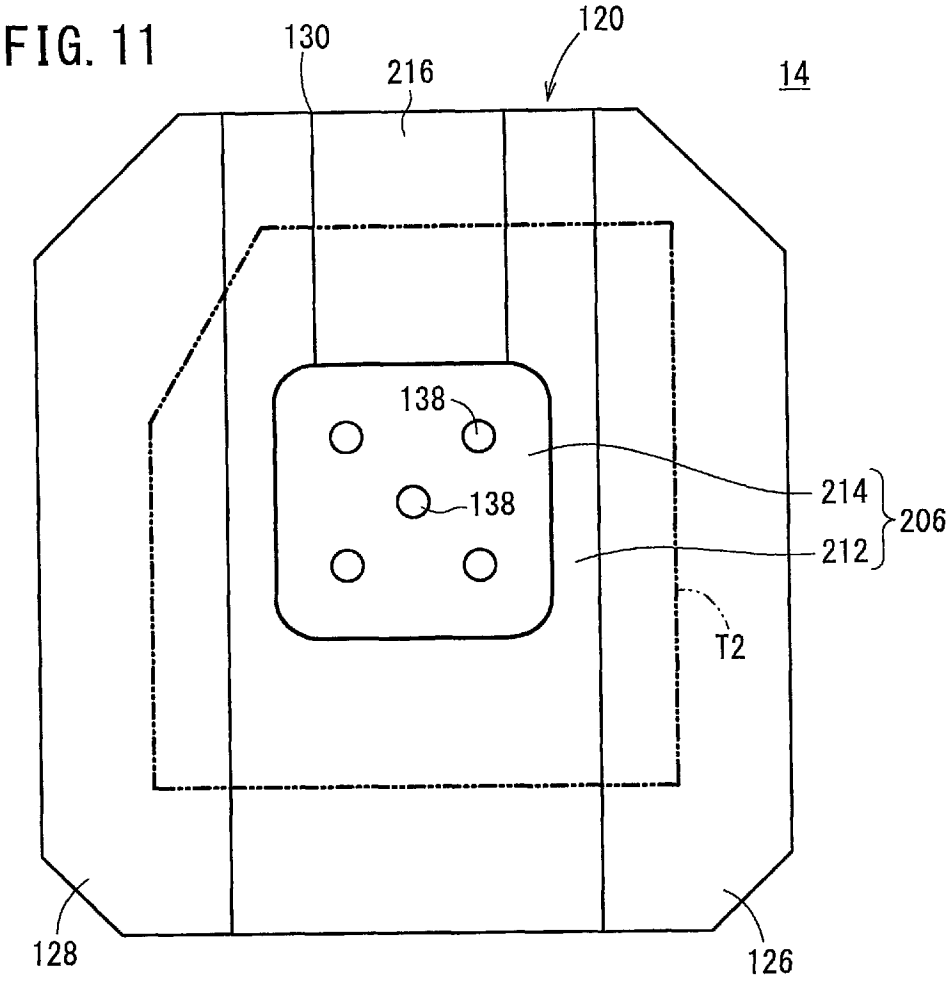
FIG. 11 is a rear elevational view of the main movable die body shown in FIG. 10.

As shown in FIGS. 10 and 11, the base 130 has a substantially rectangular channel defined substantially centrally in a widthwise direction in the rear surface of the base 130 and which extends over the full length of the base 130. The channel, which is defined in the base 130, makes the base 130 into a pair of side blocks 202, 204, and a thin-walled attachment plate 206 that extends between the side blocks 202, 204 centrally in the base 130. The support block 126 is fixed to a rear surface of the side block 202, whereas the support block 128 is fixed to a rear surface of the side block 204.

The attachment plate 206 has a square recess defined substantially centrally in a rear surface thereof. The square recess, which is defined in the attachment plate 206, makes the attachment plate 206 into a main attachment plate body (support) 212, and a thin-walled panel (pressure boosting unit, deformable portion) 214, which is disposed on and formed thinner than the main attachment plate body 212. In other words, the main attachment plate body 212 is positioned around the thin-walled panel 214. As shown in FIG. 10, the rear surface of the main attachment plate body 212 has a dent 216, which is defined substantially centrally widthwise in one end portion of the main attachment plate body 212, and is joined to the channel behind the thin-walled panel 214. The thickness of the portion of the main attachment plate body 212 in which the dent 216 is defined is greater than the thickness of the thin-walled panel 214.

The thin-walled panel 214 is positioned behind the cavity-forming portion 176 (see FIG. 1). The thin-walled panel 214 has a plurality of through holes 138 defined therein. The thin-walled panel 214 is lower in rigidity than the main attachment plate body 212. More specifically, the thin-walled panel 214 is sufficiently rigid, such that when the casting die assembly 10 is closed, the thin-walled panel 214 is elastically deformed to become convex in a direction away from the movable cavity die 122. Accordingly, the thin-walled panel 214 is made more elastically deformable than the main attachment plate body 212.

As shown in FIGS. 9 and 11, the base 130 includes a region T2, i.e., the region indicated by the two-dot-and-dash lines shown in FIGS. 9 and 11, which is referred to as a second contact region and is in contact with the flat rear surface 136 of the movable cavity die 122. The region T2 includes the main attachment plate body 212 and the thin-walled panel 214, both of which support the movable cavity die 122.

In the movable die 14 as above, the movable cavity die 122 is installed on the main movable die body 120 in the following manner. First, the movable cavity die 122 is placed on the main movable die body 120 such that the flat rear surface 136 of the movable cavity die 122 is brought into contact with the flat attachment surface 134 of the base 130, and the first surface 150 of the flange 132 is brought into contact with or abutment against the second surface 166 of the movable cavity die 122.

At this time, the sprue pin 152 is disposed in the first recess 154 and the second recess 168, thereby positioning the movable cavity die 122 with respect to the main movable die body 120 along the transverse direction of the base 130.

Thereafter, the mounting bolts 142 mounted on the base 130 are threaded into respective bolt holes, not shown, defined in the flat rear surface 136 of the movable cavity die 122. In addition, the joint bolts 158, 160 are inserted respectively through the insertion holes 162, 164 in the flange 132, and threaded into the respective bolt holes 170, 172 in the movable cavity die 122. As a result, the movable cavity die 122 becomes fastened to the main movable die body 120.

Figure 7:
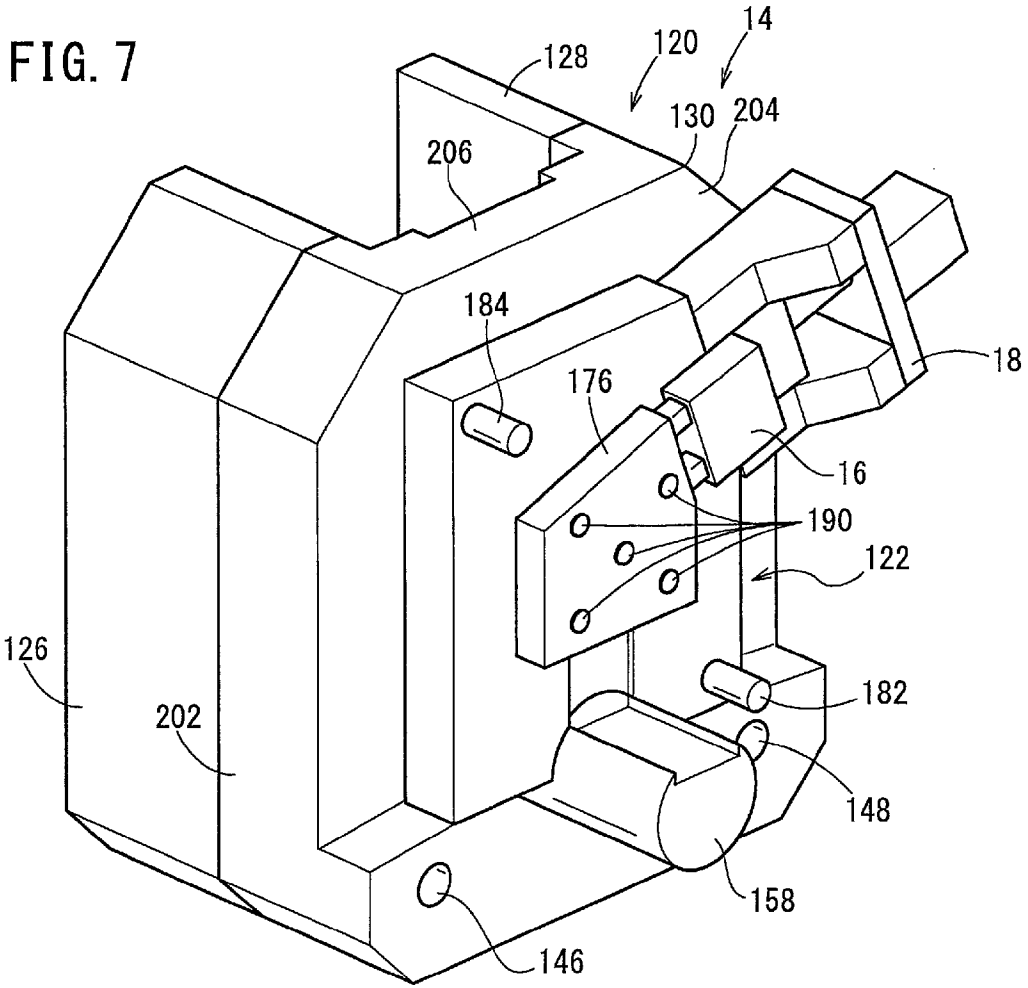
FIG. 7 is a perspective view of a movable die, a slide die, and a slide mechanism of the casting die assembly, as viewed from a front side thereof.
Figure 8:
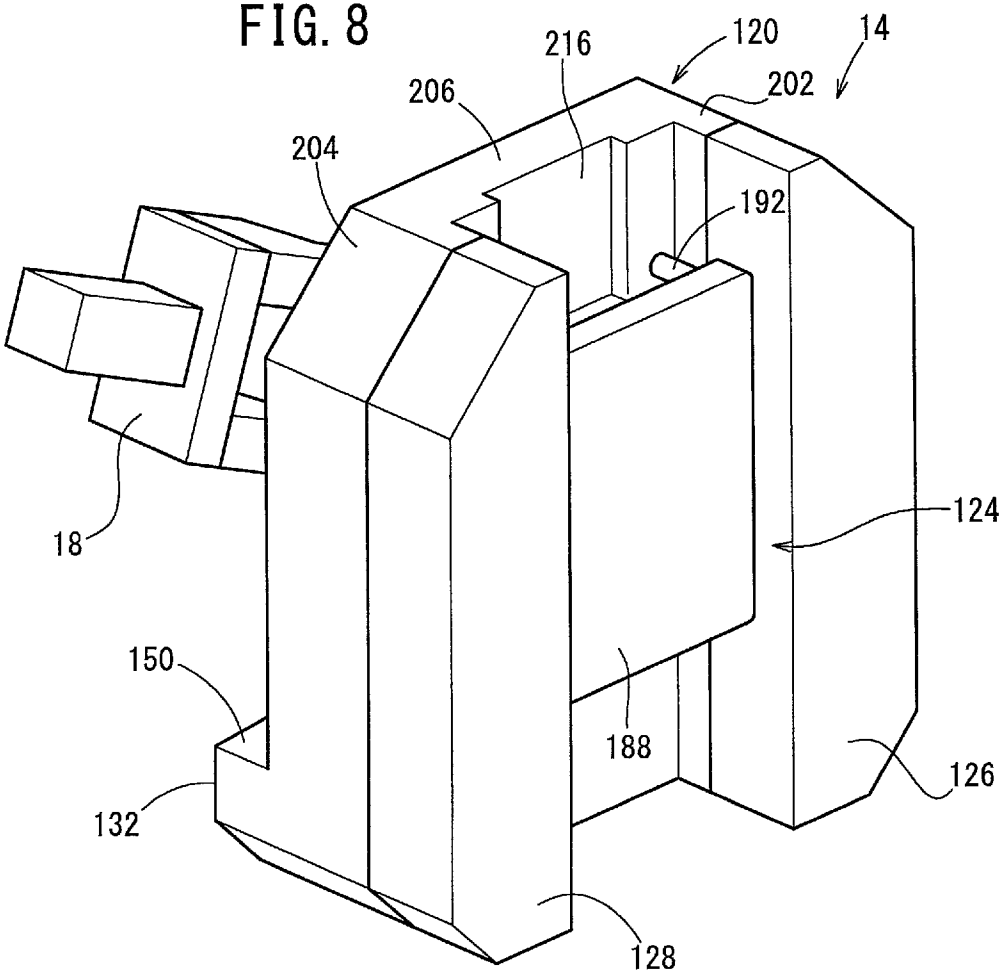
FIG. 8 is a perspective view of the movable die shown in FIG. 7, with a rear side of the movable die being shown.

As shown in FIGS. 7 and 9, the slide die 16, which serves as a die for forming the cavity C, is smaller and lighter in weight than the fixed die 12 and the movable die 14. The slide mechanism 18, in a state of being fixedly mounted on the movable cavity die 122, supports the slide die 16 for movement toward and away from the cavity-forming portion 176 of the movable die 14.

The casting die assembly 10 according to the present embodiment basically is constructed as described above. Operations and advantages of the casting die assembly 10 will be described below.

For performing a die casting process using the casting die assembly 10, the movable die 14 initially is displaced toward the fixed die 12. The positioning pins 46, 48 of the main fixed die body 20 are inserted into the positioning holes 146, 148 in the main movable die body 120. At this time, the main fixed die body 20 and the main movable die body 120 are positioned with respect to each other. The positioning pins 182, 184 of the movable cavity die 122 are inserted into the positioning holes 82, 84 in the fixed cavity die 22. At this time, the movable cavity die 122 and the fixed cavity die 22 are positioned with respect to each other.

Upon further displacement of the movable die 14 toward the fixed die 12, the respective distal ends of the return pins 92 of the fixed die 12 are pushed by the mating surface 174 of the movable cavity die 122, thereby retracting the ejector plate 88 and the ejector pins 90 of the fixed die 12 to their initial positions. Further, the ejector plate 188 and the ejector pins 190 of the movable die 14 are retracted to their initial positions by an actuating means, not shown.

The mating surface 174 of the movable cavity die 122 and the mating surface 72 of the fixed cavity die 22 are brought into contact with each other. A non-illustrated actuator of the slide mechanism 18 is operated to move the slide die 16 forwardly toward the cavity-forming portion 176. Following movement thereof, the fixed cavity die 22, the movable cavity die 122, and the slide die 16 jointly define the cavity C.

Thereafter, the movable die 14 is pressed against the fixed die 12 in order to apply a predetermined die closing force between the movable cavity die 122 and the fixed cavity die 22. At this time, the outer circumferential portion of the main movable die body 120 is pressed against the fixed die 12.

Figure 12:
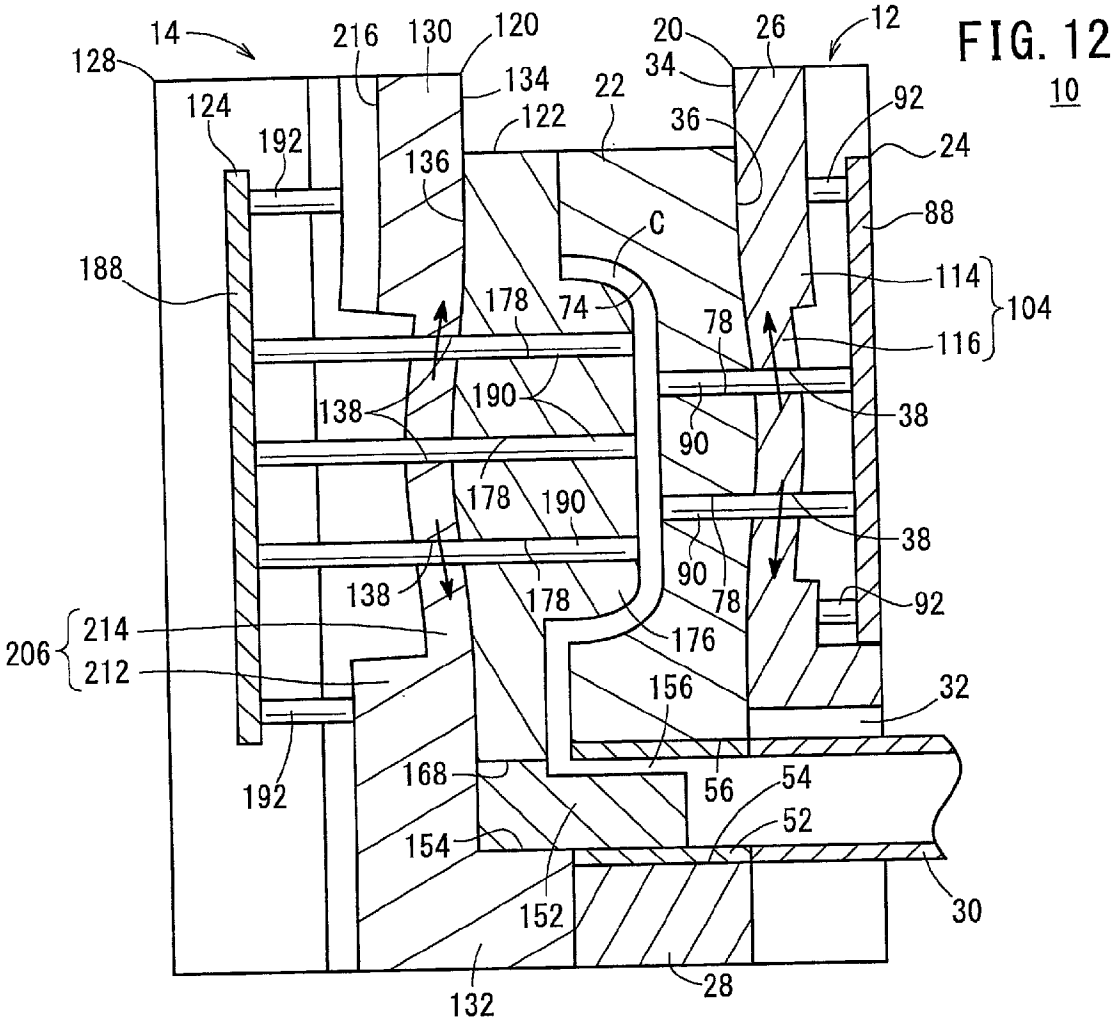
FIG. 12 is a vertical cross-sectional view, partially omitted from illustration, of the casting die assembly shown in FIG. 1, with the casting die assembly being shown in a closed state.

When the movable die 14 is pressed against the fixed die 12, as shown in FIG. 12, the plate-shaped base 26 of the main fixed die body 20 is elastically deformed, so as to become convex toward the ejector plate 88. Since the rigidity of the thin-walled panel 116 is smaller than the rigidity of the main attachment plate body 114, the thin-walled panel 116 flexes more greatly than the main attachment plate body 114.

Since the elastic force (restoring force) of the thin-walled panel 116 acts on the main attachment plate body 114 around the thin-walled panel 116, the main attachment plate body 114 applies an increased pressing force to the fixed cavity die 22. Consequently, the portion of the fixed cavity die 22 that is supported by the main attachment plate body 114 is deformed less than other portions of the fixed cavity die 22. According to the present embodiment, in particular, inasmuch as the thin-walled panel 116 is disposed behind the cavity-forming portion 74, deformation of the portion of the fixed cavity die 22 that is positioned around the cavity-forming portion 74 is minimized.

Similarly, when the movable die 14 is pressed against the fixed die 12, a reaction from the fixed die 12 elastically deforms the plate-shaped base 130 of the main movable die body 120, so as to become convex toward the ejector plate 188. Since the rigidity of the thin-walled panel 214 is smaller than the rigidity of the main attachment plate body 212, the thin-walled panel 214 flexes more greatly than the main attachment plate body 212.

Since the elastic force (restoring force) of the thin-walled panel 214 acts on the main attachment plate body 212 around the thin-walled panel 214, the main attachment plate body 212 applies an increased pressing force to the movable cavity die 122. Consequently, the portion of the movable cavity die 122 that is supported by the main attachment plate body 212 is deformed less than other portions of the movable cavity die 122. According to the present embodiment, in particular, inasmuch as the thin-walled panel 214 is disposed behind the cavity-forming portion 176, deformation of the portion of the movable cavity die 122 that is positioned around the cavity-forming portion 176 is minimized.

Therefore, upon closure of the casting die assembly 10, the movable cavity die 122 and the fixed cavity die 22 are kept in high intimate contact with each other. In other words, a gap through which the cavity C communicates with the outside is not formed between the movable cavity die 122 and the fixed cavity die 22. Accordingly, when an unillustrated molten metal supply source is operated in order to pour molten metal into the cavity C, the introduced molten metal does not leak outside of the cavity C, thereby preventing metal spits from being produced.

When the molten metal introduced into the cavity C has solidified into a cast product, the movable die 14 is moved away from the fixed die 12, and the slide die 16 is retracted by the slide mechanism 18. If the cast product is stuck to the fixed cavity die 22, then the ejector plate 88 of the fixed die 12 is pressed toward the base 26 by a non-illustrated pressing means, thereby causing the ejector pins 90 to project from the cavity-forming portion 74 in order to remove the cast product from the fixed cavity die 22. On the other hand, if the cast product is stuck to the movable cavity die 122, then the ejector plate 188 of the movable die 14 is pressed toward the base 130 by a non-illustrated pressing means, thereby causing the ejector pins 190 to project from the cavity-forming portion 176 in order to remove the cast product from the movable cavity die 122. Thus, upon removal thereof from the casting die assembly 10, the cast product has a minimum of burrs, and hence exhibits high dimensional accuracy. At this time, the die casting process using the casting die assembly 10 is finished.

According to the present embodiment, when the movable die 14 and the fixed die 12 are combined, i.e., upon closure of the casting die assembly 10, the thin-walled panel 116 of the main fixed die body 20 is elastically deformed so as to become convex toward the ejector plate 88, i.e., away from the fixed cavity die 22. Consequently, the elastic force (restoring force) of the thin-walled panel 116 acts on the main attachment plate body 114, so as to apply an increased pressing force by the main attachment plate body 114 to the fixed cavity die 22. Stated otherwise, when the movable die 14 and the fixed die 12 are combined, the thin-walled panel 116 boosts the pressure that is applied through the main attachment plate body 114 to the fixed cavity die 22. Therefore, deformation of the portion of the fixed cavity die 22, which is supported on the main attachment plate body 114, is minimized.

Similarly, when the movable die 14 and the fixed die 12 are combined, i.e., upon closure of the casting die assembly 10, the thin-walled panel 214 of the main movable die body 120 is elastically deformed to become convex away from the movable cavity die 122. Thus, the thin-walled panel 214 makes it possible to increase the pressure applied to the movable cavity die 122 through the main attachment plate body 212. Therefore, deformation of the portion of the movable cavity die 122, which is supported on the main attachment plate body 212, is minimized. Any gap connecting the cavity C to the exterior of the casting die assembly 10 is prevented from being formed upon closure of the casting die assembly 10, and therefore, burrs on the cast product are minimized.

Since the flat rear surface 36 of the fixed cavity die 22 is attached to the flat attachment surface 34 of the plate-shaped base 26 of the main fixed die body 20, the main fixed die body 20 does not require a recess for fitting of the fixed cavity die 22 therein. Likewise, since the flat rear surface 136 of the movable cavity die 122 is attached to the flat attachment surface 134 of the plate-shaped base 130 of the main movable die body 120, the main movable die body 120 does not require a recess for fitting of the movable cavity die 122 therein. Consequently, the cost and weight of the casting die assembly 10 can be reduced, and the casting die assembly 10 can be made versatile in use.

According to the present embodiment, since the thin-walled panel 116 of the main fixed die body 20 is thinner than the main attachment plate body 114, the thin-walled panel 116 effectively is made elastically deformable while the main attachment plate body 114 is made less deformable. Similarly, since the thin-walled panel 214 of the main movable die body 120 is thinner than the main attachment plate body 212, the thin-walled panel 214 effectively is made elastically deformable while the main attachment plate body 212 is made less deformable. Therefore, burrs on the cast product are minimized efficiently.

According to the present embodiment, the thin-walled panel 116 of the main fixed die body 20 is positioned behind the cavity-forming portion 74, and the main attachment plate body 114 is positioned around the thin-walled panel 116. Therefore, deformation of the portion of the fixed cavity die 22 around the cavity-forming portion 74 is reduced to an appropriate level. In addition, the thin-walled panel 214 of the main movable die body 120 is positioned behind the cavity-forming portion 176, and the main attachment plate body 212 is positioned around the thin-walled panel 214. Therefore, similarly, deformation of the portion of the movable cavity die 122 around the cavity-forming portion 176 is reduced to an appropriate level. As a result, burrs on the cast product are minimized more effectively.

According to the present embodiment, the through holes 38 are defined in the thin-walled panel 116 of the main fixed die body 20, thereby making the thin-walled panel 116 more elastically deformable. Similarly, the through holes 138 are defined in the thin-walled panel 214 of the main movable die body 120, thereby making the thin-walled panel 214 more elastically deformable.

According to the present embodiment, since the fixed cavity die 22 and the flange 28 are joined to each other by the joint bolts 56, 58, the fixed cavity die 22 is prevented from becoming positionally displaced with respect to the main fixed die body 20 when the fixed cavity die 22 is subjected to thermal expansion and contraction. The fixed cavity die 22 expands thermally away from the flange 28, i.e., in the direction in which the first surface 50 faces, so that upon thermal expansion of the fixed cavity die 22, the main fixed die body 20 (the flange 28) and the fixed cavity die 22 are prevented from being damaged.

Likewise, since the movable cavity die 122 and the flange 132 are joined to each other by the joint bolts 158, 160, the movable cavity die 122 is prevented from becoming positionally displaced with respect to the main movable die body 120 when the movable cavity die 122 is subjected to thermal expansion and contraction. The movable cavity die 122 expands thermally away from the flange 132, i.e., in the direction in which the first surface 150 faces, so that upon thermal expansion of the movable cavity die 122, the main movable die body 120 (the flange 132) and the movable cavity die 122 are prevented from being damaged.

According to the present embodiment, a portion of the sprue sleeve 52 is disposed in the first recess 54 in the flange 28 of the main fixed die body 20, and the other portion of the sprue sleeve 52 is disposed in the second recess 66 in the fixed cavity die 22. Accordingly, the fixed cavity die 22 is easily positioned widthwise with respect to the main fixed die body 20, i.e., in a direction perpendicular to the direction in which the flange 28 projects, and perpendicular to the direction which the first surface 50 faces. The sprue sleeve 52, which is used as a positioning member, makes it unnecessary to provide a new dedicated positioning member, thereby resulting in a reduction in the number of parts. Since the fixed cavity die 22 is prevented from becoming positionally displaced with respect to the main fixed die body 20, the dimensional accuracy of the cast product can be increased.

According to the present embodiment, a portion of the sprue pin 152 is disposed in the first recess 154 in the flange 132 of the main movable die body 120, whereas the other portion of the sprue pin 152 is disposed in the second recess 168 of the movable cavity die 122. Accordingly, the movable cavity die 122 is easily positioned widthwise with respect to the main movable die body 120, i.e., in a direction perpendicular to the direction in which the flange 132 projects, and perpendicular to the direction in which the first surface 150 faces. The sprue pin 152, which is used as a positioning member, makes it unnecessary to provide a new dedicated positioning member, thereby resulting in a reduction in the number of parts. Further, since the movable cavity die 122 is prevented from becoming positionally displaced with respect to the main movable die body 120, the dimensional accuracy of the cast product can be increased.

Figure 13:
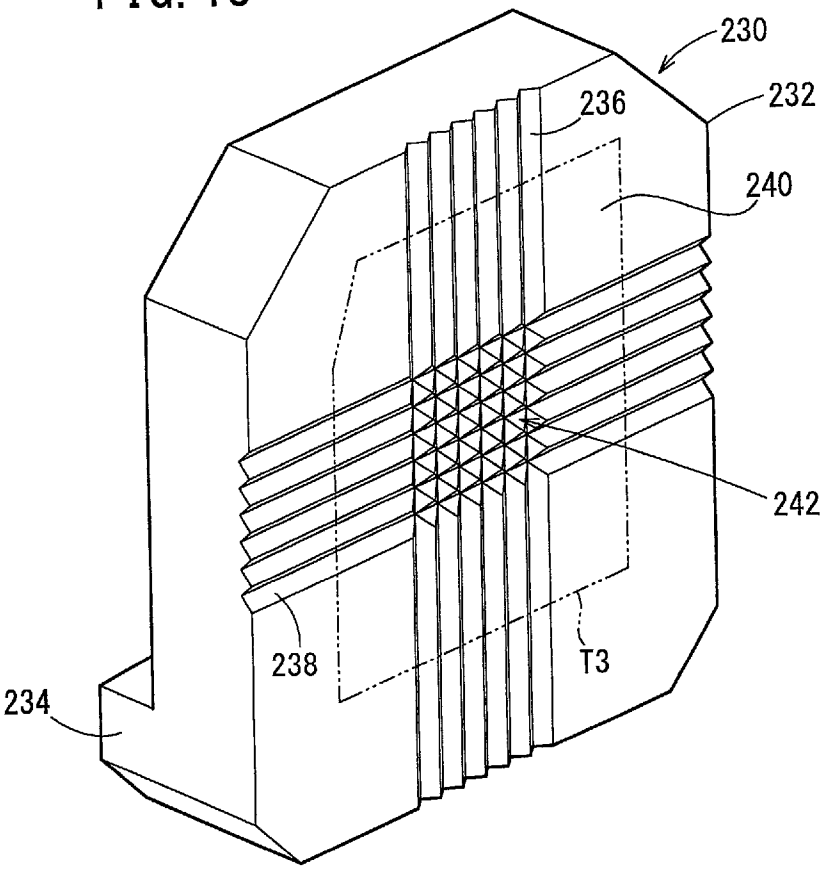
FIG. 13 is a perspective view of a main die body according to a modification of the present invention.

The present embodiment is not limited to the above structural details. Each of the main fixed die body 20 and the main movable die body 120 may be replaced with a main die body 230 according to the modification shown in FIG. 13. The main die body 230 has a plate-shaped base 232 and a flange 234. A plurality of first grooves 236 are defined in a rear portion of the base 232. The first grooves 236 extend over the full length of the base 232 and are arrayed along the transverse direction thereof. The main die body 230 also has a plurality of second grooves 238, which extend over the full width of the base 232 and are arrayed along the longitudinal direction thereof. The first grooves 236 are positioned substantially centrally in the base 232 along the transverse direction thereof, whereas the second grooves 238 are positioned substantially centrally in the base 232 along the longitudinal direction thereof. As illustrated in FIG. 13, each of the first grooves 236 and the second grooves 238 are V-shaped in cross-section, although the grooves may be of any desired cross-sectional shape.

The main die body 230, which is constructed in the foregoing manner, is less rigid in a crossing region (pressure boosting unit, deformable portion) 242 where the first grooves 236 and the second grooves 238 cross each other than in other regions thereof. More specifically, the base 232 has a region T3, which is held in contact with the rear surface of a cavity die (the fixed cavity die 22 or the movable cavity die 122). Additionally, the region T3 includes an attachment plate body (support) 240 for supporting the cavity die and the crossing region 242, which is less rigid than the attachment plate body 240.

Upon closure of the casting die assembly 10, the crossing region 242 becomes elastically deformed in a convex manner away from the cavity die. Therefore, the main die body 230 offers the same advantages as those of the embodiment described above.

Second Embodiment

A casting die assembly 10A according to a second embodiment of the present invention will be described below with reference to FIGS. 14 through 17. Parts of the casting die assembly 10A according to the second embodiment, which are identical to those of the casting die assembly 10 according to the first embodiment, are denoted by identical reference characters, and such features will not be described in detail below.

Figure 14:
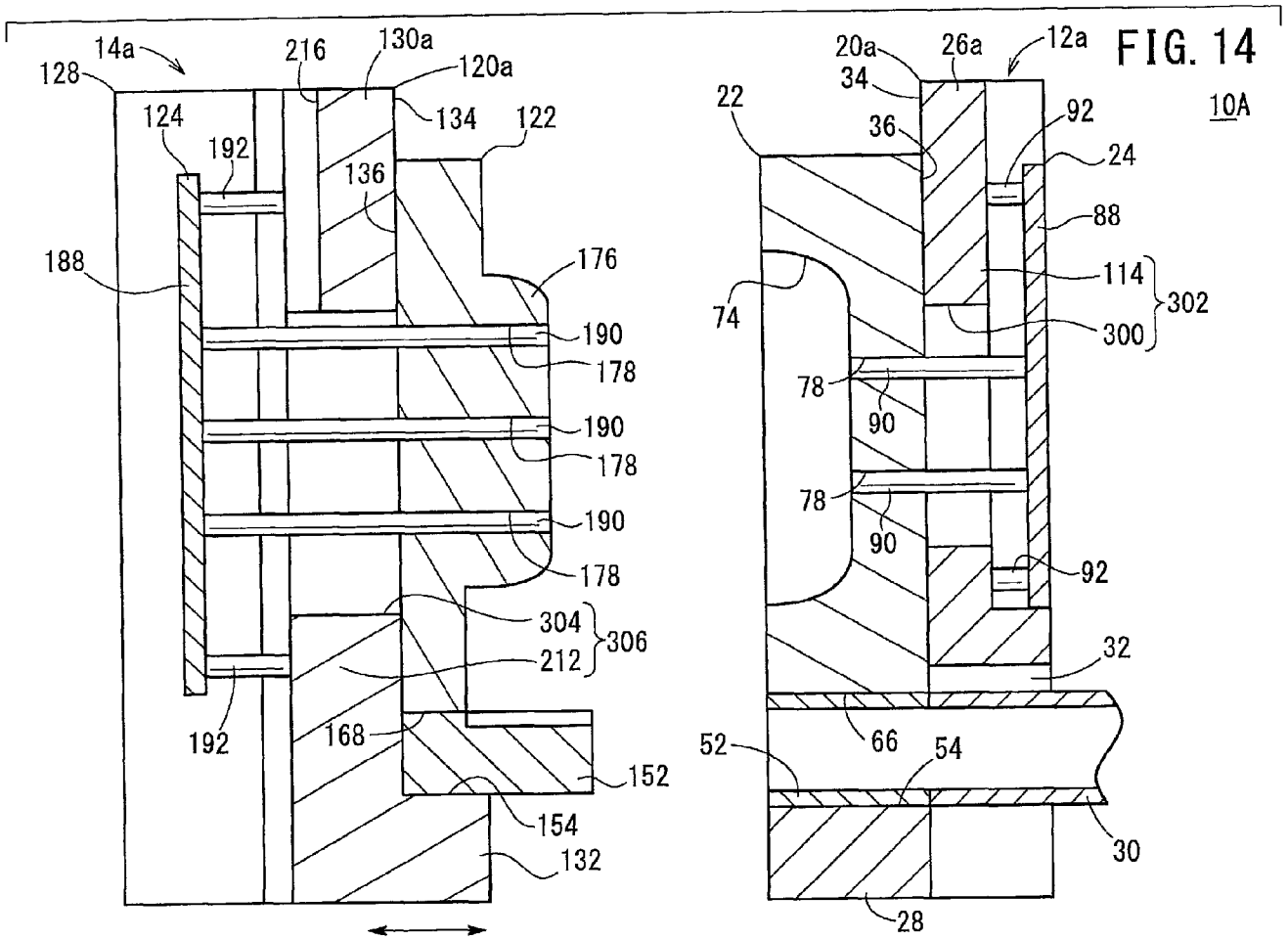
FIG. 14 is a vertical cross-sectional view, partially omitted from illustration, of a casting die assembly according to a second embodiment of the present invention, with the casting die assembly being shown in an open state.
Figure 15:
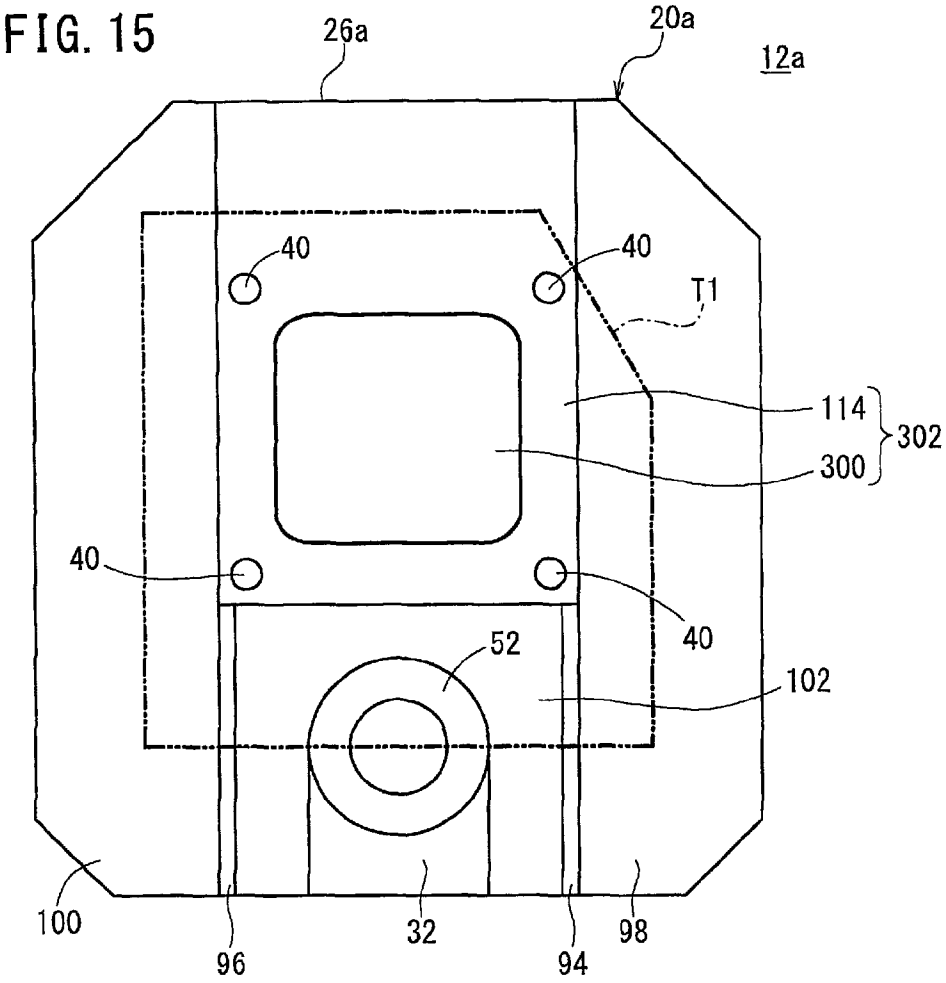
FIG. 15 is a rear elevational view of a main fixed die body of a fixed die shown in FIG. 14.
Figure 16:
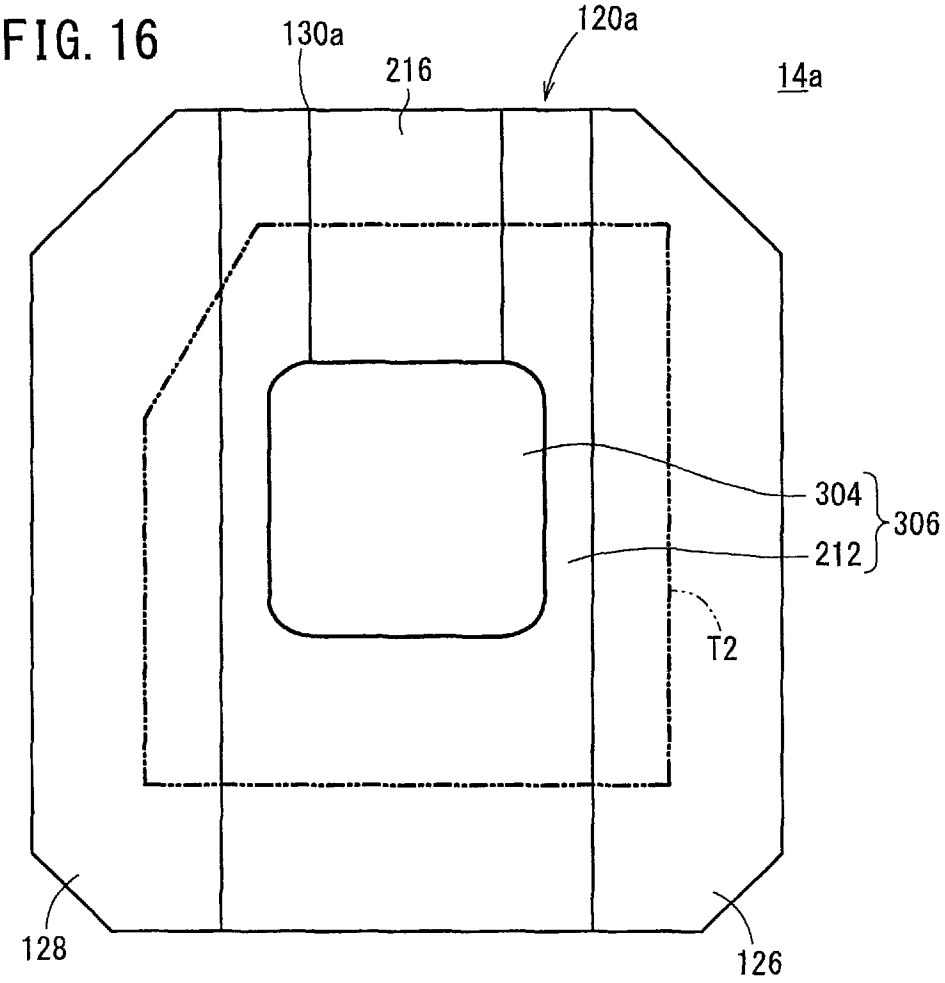
FIG. 16 is a rear elevational view of a main movable die body of a movable die shown in FIG. 14.

As shown in FIGS. 14 through 16, the casting die assembly 10A according to the second embodiment includes a fixed die (first die) 12*a* and a movable die (second die) 14*a*. The fixed die 12*a* has a main fixed die body 20*a* including a base 26*a*. The base 26*a* includes an attachment plate 302 having a square hole (pressure boosting unit) 300 defined therein, which is provided instead of the thin-walled panel 116 described above, and a main attachment plate body (support) 114. The hole 300 is of a size that is large enough for the ejector pins 90 to be inserted therein.

The movable die 14*a* includes a main movable die body 120*a* including a base 130*a*. The base 130*a* includes an attachment plate 306 having a square hole (pressure boosting unit) 304 defined therein, which is provided instead of the thin-walled panel 214 described above, and a main attachment plate body (support) 212. The hole 304 is of a size that is large enough for the ejector pins 190 to be inserted therein.

According to the present embodiment, since the main fixed die body 20*a* has the hole 300 therein, it is possible for the contact area of the fixed cavity die 22 with the base 26*a* to be reduced without changing the contact area of the fixed cavity die 22 with the main attachment plate body 114. Consequently, the pressure applied through the main attachment plate body 114 (first contact region T1) to the fixed cavity die 22 can be increased to an appropriate level.

Similarly, since the main movable die body 120*a* has the hole 304 therein, it is possible for the contact area of the movable cavity die 122 with the base 130*a* to be reduced without changing the contact area of the movable cavity die 122 with the main attachment plate body 212. Consequently, the pressure applied through the main attachment plate body 212 (second contact region T2) to the movable cavity die 122 can be increased to an appropriate level.

According to the present embodiment, the hole 300 is large enough for the ejector pins 90 to be inserted therein, and the hole 304 is large enough for the ejector pins 190 to be inserted therein. Therefore, even if the layout of the ejector pins 90, 190 is changed depending on the shape of a product to be cast, the ejector pins 90, 190 can still be inserted in the holes 300, 304. In other words, the hole 300 doubles as a hole through which the ejector pins 90 can be inserted, and the hole 304 doubles as a hole through which the ejector pins 190 can be inserted. Stated otherwise, there is no need for a new main fixed die body and a new main movable die body to be produced responsive to changes made in the layout of the ejector pins 90, 190. Consequently, the cost of the casting die assembly 10A is prevented from increasing, even if differently shaped products are cast.

Figure 17:
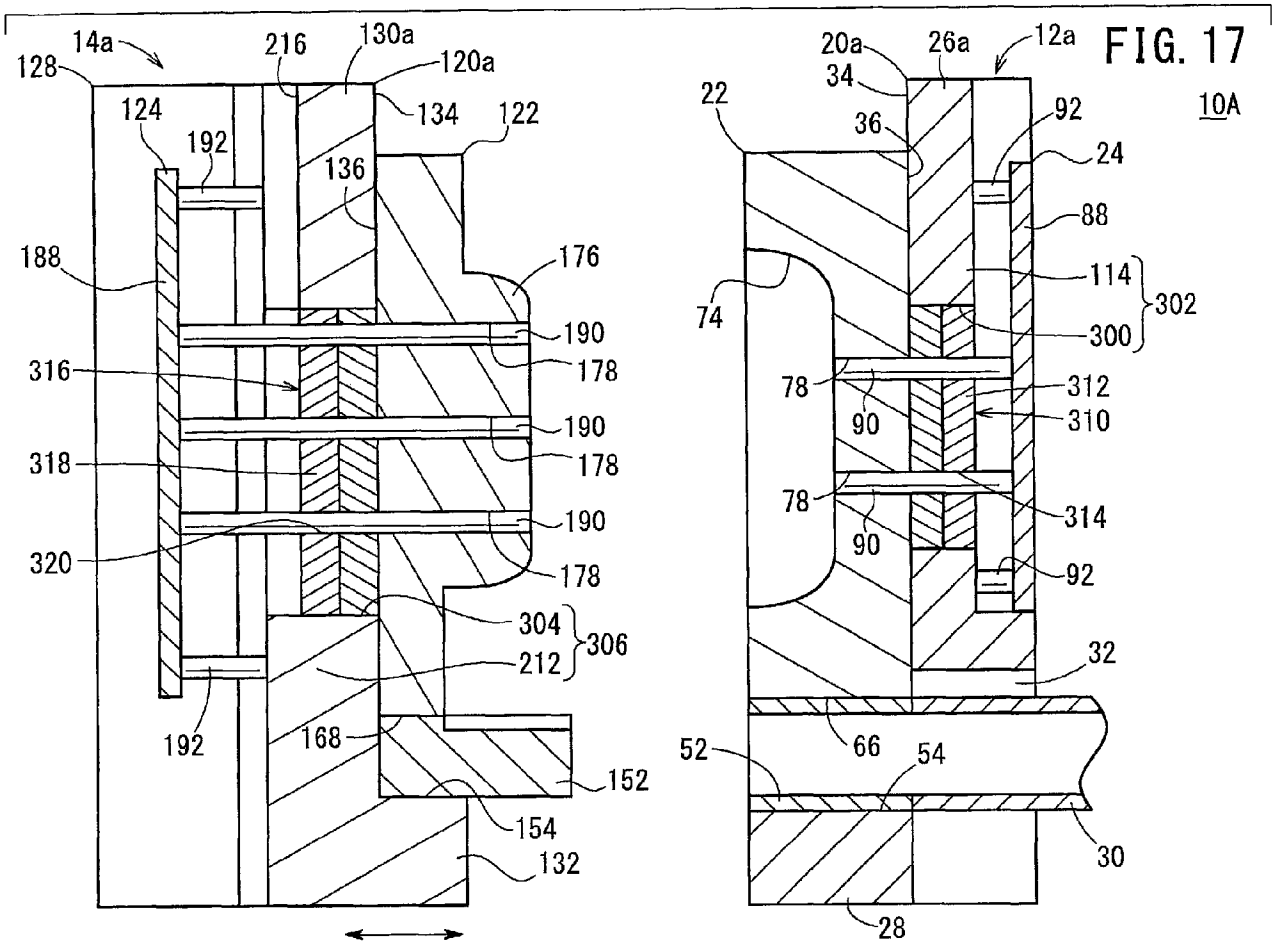
FIG. 17 is a vertical cross-sectional view, partially omitted from illustration, of a modification of the casting die assembly shown in FIG. 14.

The present embodiment is not limited to the above structure. For example, as shown in FIG. 17, in the hole 300 of the base 26*a* of the main fixed die body 20*a*, a reinforcement member (metal member) 310 may be provided by being fixed to the rear surface 36 of the fixed cavity die 22 through a plurality of unillustrated bolts or the like, in order to prevent deformation of the fixed cavity die 22 during the casting process.

The reinforcement member 310 is formed by stacking a plurality of metal plates 312. In this case, the rigidity of the reinforcement member 310 can be easily adjusted by changing the number of stacked metal plates 312. Incidentally, the shape, the material, and the thickness of each metal plate 312 can be set arbitrarily.

The metal plates 312 are joined together in a stacked state by use of the bolts through which the metal plates 312 are fixed to the rear surface 36 of the fixed cavity die 22. Accordingly, each of the metal plates 312 has a plurality of unillustrated insertion holes through which the respective bolts are inserted. As is obvious from FIG. 17, each of the metal plates 312 has a plurality of through holes 314 through which the respective ejector pins 90 are inserted.

Further, for example, in a case that an insert die is placed in the fixed cavity die 22 and the flange of the insert die is placed in the hole 300 such that the flange of the insert die is in contact with the rear surface 36 of the fixed cavity die 22, a recess or a hole for receiving the flange of the insert die preferably should be formed in one of the metal plates 312 that is positioned closest to the fixed cavity die 22. Owing thereto, the reinforcement member 310 can be placed in contact with the rear surface 36 of the fixed cavity die 22 reliably. Thus, deformation of the fixed cavity die 22 during the casting process can be prevented effectively.

The reinforcement member 310 may be formed by a single metal plate 312. In this case, a plurality of metal plates 312 having different plate thicknesses are provided in advance, and one metal plate 312 having the most appropriate thickness for a casting condition, etc. is selected from among the metal plates 312.

On the other hand, in the hole 304 of the base 130*a* of the main movable die body 120*a*, a reinforcement member (metal member) 316 may be provided by being fixed to the rear surface 136 of the movable cavity die 122 through a plurality of unillustrated bolts, in order to prevent deformation of the movable cavity die 122 during the casting process.

The reinforcement member 316 is formed by stacking a plurality of metal plates 318. In this case, the rigidity of the reinforcement member 316 can be easily adjusted by changing the number of stacked metal plates 318. Incidentally, the shape, the material, and the thickness of each metal plate 318 can be set arbitrarily.

The metal plates 318 are joined together in a stacked state by use of the bolts through which the metal plates 318 are fixed to the rear surface 136 of the movable cavity die 122. Accordingly, each of the metal plates 318 has a plurality of unillustrated insertion holes through which the respective bolts are inserted. As is obvious from FIG. 17, each of the metal plates 318 has a plurality of through holes 320 through which the respective ejector pins 190 are inserted.

For example, in a case that an insert die is placed in the movable cavity die 122 and the flange of the insert die is placed in the hole 304 such that the flange of the insert die is in contact with the rear surface 136 of the movable cavity die 122, a recess or a hole for receiving the flange of the insert die preferably should be formed in one of the metal plates 318 that is positioned closest to the movable cavity die 122. Owing thereto, the reinforcement member 316 can be placed in contact with the rear surface 136 of the movable cavity die 122 reliably. Thus, deformation of the movable cavity die 122 during the casting process can be prevented effectively.

The reinforcement member 316 may be formed by a single metal plate 318. In this case, a plurality of metal plates 318 having different plate thicknesses are provided in advance, and one metal plate 318 having the most appropriate thickness for a given casting condition, etc. is selected from among the metal plates 318.

According to the modification shown in FIG. 17, the reinforcement member 310 is provided in the hole 300 of the base 26*a*, while being fixed to the rear surface 36 of the fixed cavity die 22. Thus, the reinforcement member 310 can prevent the fixed cavity die 22 from being excessively deformed during the casting process. As a result, the dimensional accuracy of a cast product can be increased. Further, the reinforcement member 310 is formed by stacking a plurality of metal plates 312, and thus the number of stacked metal plates 312 is changed, whereby the rigidity of the reinforcement member 310 can be adjusted easily.

As with the above, the reinforcement member 316 is provided in the hole 304 of the base 130*a*, while being fixed to the rear surface 136 of the movable cavity die 122. Thus, the reinforcement member 316 can prevent the movable cavity die 122 from being excessively deformed during the casting process. As a result, the dimensional accuracy of a cast product can be increased. Further, the reinforcement member 316 is formed by stacking a plurality of metal plates 318, and thus the number of stacked metal plates 318 is changed, whereby the rigidity of the reinforcement member 316 can be adjusted easily.

The present invention is not limited to the above embodiments. It is a matter of course that various changes and modifications can be made to the embodiments without departing from the scope of the invention as set forth in the appended claims.

The invention claimed is:

1. A casting die assembly comprising:

a first die and a second die, which face each other and are configured to be movable toward and away from each other;

wherein at least one of the first die and the second die includes:

a cavity die;

a plate-shaped base having a flat attachment surface to which a rear surface of the cavity die is attached; and a flange that projects from the base toward the cavity die, abuts against a side surface of the cavity die, and extends over a full width of the base; and a joint member joining the flange and the cavity die to each other;

wherein a main die body formed of the base and the flange is substantially L-shaped as viewed in side elevation;

the base includes a region held in contact with the rear surface of the cavity die;

the region having:

a support configured to support the cavity die; and a pressure boosting unit configured to increase a pressure applied through the support to the cavity die when the first die and the second die are combined with each other;

wherein the pressure boosting unit has a deformable portion, which is less rigid than the support, the deformable portion being configured to be elastically deformed to become convex away from the cavity die when the first die and the second die are combined with each other;

wherein:

the flange has a first surface facing the cavity die, and the first surface has a first recess in which a portion of a sprue sleeve or a portion of a sprue pin is disposed;

the cavity die has a second surface facing the flange, and the second surface has a second recess in which another portion of the sprue sleeve or another portion of the sprue pin is disposed; and when the sprue sleeve or the sprue pin is disposed in the first recess and the second recess, the cavity die is positioned with respect to the base along a direction perpendicular to a direction in which the flange projects, and perpendicular to a direction in which the first surface faces.

2. The casting die assembly according to claim 1, wherein the deformable portion is thinner than the support.

3. The casting die assembly according to claim 2, wherein the deformable portion has a through hole therein.

4. The casting die assembly according to claim 1, wherein the pressure boosting unit has a hole therein.

5. The casting die assembly according to claim 4, further comprising:

a plurality of ejector pins configured to remove a cast product from the cavity die, wherein the hole is large enough for the ejector pins to be inserted therein.

6. The casting die assembly according to claim 4, wherein in the hole, a reinforcement member is provided by being fixed to the rear surface of the cavity die.

7. The casting die assembly according to claim 6, wherein the reinforcement member is formed by stacking a plurality of metal plates.

8. The casting die assembly according to claim 1, wherein the support is disposed around the pressure boosting unit; and the pressure boosting unit is disposed behind a cavity-forming portion of the cavity die.

* * * * *